US012709972B2

(12) United States Patent
Uvarov et al.

(10) Patent No.: US 12,709,972 B2
(45) Date of Patent: Aug. 18, 2026

(54) WELL ANTI-COLLISION USING A STRATIGRAPHIC FACTOR MODEL

(71) Applicant: RNA Capital Inc., Houston, TX (US)

(72) Inventors: Igor Uvarov, Houston, TX (US); Igor Kuvaev, Houston, TX (US)

(73) Assignee: RNA Capital, Inc., Houston, TX (US)

( * ) Notice: Subject to any disclaimer, the term of this patent is extended or adjusted under 35 U.S.C. 154(b) by 0 days.

(21) Appl. No.: 19/069,188

(22) Filed: Mar. 3, 2025

(65) Prior Publication Data

US 2025/0277438 A1 Sep. 4, 2025

Related U.S. Application Data

(60) Provisional application No. 63/561,225, filed on Mar. 4, 2024, provisional application No. 63/561,217, filed on Mar. 4, 2024.

(51) Int. Cl.
*E21B 44/00* (2006.01)
*E21B 47/022* (2012.01)

(52) U.S. Cl.
CPC ..... *E21B 44/00* (2013.01); *E21B 47/022* (2013.01); *E21B 2200/20* (2020.05); *E21B 2200/22* (2020.05)

(58) Field of Classification Search
CPC .... E21B 44/00; E21B 47/022; E21B 2200/20; E21B 2200/22
See application file for complete search history.

(56) References Cited

U.S. PATENT DOCUMENTS 8,793,111 B2 7/2014 Tilke et al.
8,875,806 B2 11/2014 Williams
9,378,419 B2 6/2016 Simske et al.
10,168,447 B2 1/2019 Priezzhev et al.
10,353,356 B2 7/2019 Woodward et al.
10,677,052 B2 6/2020 Storm, Jr. et al.
10,871,589 B2 12/2020 Barrou et al.
11,085,283 B2 * 8/2021 Benson ..... G05B 19/048
11,162,349 B2 11/2021 Flanagan et al.
(Continued)

FOREIGN PATENT DOCUMENTS

CA 2888037 A1 5/2014
EP 2420863 A2 2/2012
(Continued)

OTHER PUBLICATIONS

McNair, Gary, and et al. "Implementation of a New Risk Based Well Collision Avoidance Method." Paper presented at the 18th World Petroleum Congress, Johannesburg, South Africa, Sep. 2005 (Year: 2005).*

(Continued)

*Primary Examiner* — Douglas Kay

(74) *Attorney, Agent, or Firm* — Saunders McKeon, PLLC

(57) ABSTRACT

A method for avoiding well-to-well collisions by ascertaining true vertical thickness (TVT) and true stratigraphic thickness (TST) to form an integrated Stratigraphic Separation Factor (STF) computation that identifies the stratigraphic gap between distinct points along separate wellbore trajectories. A system may use a variety of measurements including subsurface sensors to perform the STF computation and its integration with drilling and geo-navigating downhole tools.

12 Claims, 6 Drawing Sheets

(56) References Cited

U.S. PATENT DOCUMENTS

| | | | | |
|---|---|---|---|---|
| 11,401,798 | B2 | 8/2022 | Panchal et al. | |
| 11,480,045 | B2 | 10/2022 | Denisenko et al. | |
| 12,312,933 | B2 * | 5/2025 | Ba | G06F 30/20 |
| 2008/0239871 | A1 * | 10/2008 | Thevoux-Chabuel | G01V 1/50 367/27 |
| 2010/0312478 | A1 | 12/2010 | Tabanou et al. | |
| 2012/0191354 | A1 | 7/2012 | Caycedo | |
| 2013/0131989 | A1 | 5/2013 | Buiting et al. | |
| 2013/0222390 | A1 | 8/2013 | Ross et al. | |
| 2013/0238306 | A1 | 9/2013 | Lagenwalter et al. | |
| 2014/0025302 | A1 | 1/2014 | Alshawaf et al. | |
| 2015/0000980 | A1 | 1/2015 | Williams | |
| 2015/0292266 | A1 | 10/2015 | Johnson et al. | |
| 2016/0076357 | A1 | 3/2016 | Hbaieb | |
| 2016/0341834 | A1 | 11/2016 | Bartetzko et al. | |
| 2018/0230781 | A1 | 8/2018 | Garcia et al. | |
| 2018/0347353 | A1 * | 12/2018 | Wang | E21B 47/12 |
| 2019/0106974 | A1 | 4/2019 | Kuvaev et al. | |
| 2020/0248545 | A1 | 8/2020 | Maus et al. | |
| 2020/0300064 | A1 | 9/2020 | Gee et al. | |
| 2020/0378248 | A1 | 12/2020 | Maus et al. | |
| 2022/0003106 | A1 * | 1/2022 | Benson | E21B 45/00 |
| 2022/0127951 | A1 | 4/2022 | Sun et al. | |
| 2022/0268147 | A1 * | 8/2022 | Chen | E21B 47/022 |
| 2023/0193736 | A1 * | 6/2023 | Thakur | G06N 20/20 703/10 |
| 2024/0044242 | A1 * | 2/2024 | Katterbauer | E21B 43/243 |
| 2024/0068350 | A1 * | 2/2024 | Zhang | E21B 7/04 |
| 2024/0183263 | A1 * | 6/2024 | Ba | E21B 41/00 |
| 2024/0247578 | A1 * | 7/2024 | Ba | E21B 7/068 |
| 2024/0411041 | A1 * | 12/2024 | Kulkarni | G01V 20/00 |
| 2025/0243710 | A1 * | 7/2025 | Zeng | E21B 47/005 |

FOREIGN PATENT DOCUMENTS

| | | | | |
|---|---|---|---|---|
| WO | 2015130836 | A1 | 9/2015 | |
| WO | WO-2023177457 | A1 * | 9/2023 | E21B 44/04 |

OTHER PUBLICATIONS

Baquero Rico, Natalia Carolina. "Quantitative risk assessment methodology on kick uncertainty during drilling stages based on probabilistic approach." (2022) (Year: 2022).*

* cited by examiner

WELL ANTI-COLLISION USING A STRATIGRAPHIC FACTOR MODEL

RELATED APPLICATIONS

This application claims priority to U.S. Provisional Application No. 63/561,225, filed Mar. 4, 2024, and U.S. Provisional Application No. 63/561,217 filed Mar. 4, 2024.

BACKGROUND

The example embodiments relate to analyzing drilling parameters over geological intervals in the field of drilling wells. Oil and gas bearing rocks are often present in layered formations. Previously, mostly vertical wells were drilled to produce hydrocarbons from these formations. However, the industry switched to horizontal well drilling as horizontal wells go along the productive formation and result in better production performance. The drilling industry, covering oil and gas extraction, geothermal energy development, and scientific research, has seen a marked rise in the density of drilled wells worldwide.

SUMMARY OF EXAMPLE EMBODIMENTS

The example embodiments relate to a technique for executing wellbore drilling operations that leverages the Stratigraphic Factor (STF), encompassing the acquisition and synthesis of geosteering intelligence via measurement-while-drilling (MWD) and logging-while-drilling (LWD) methodologies.

The example embodiments may include a technique for ascertaining true vertical thickness (TVT) and true stratigraphic thickness (TST), integral to the STF computation in wellbore drilling ventures. It may include a technique for calculating the STF employing a specific formula, aimed at identifying the stratigraphic gap between distinct points along separate wellbore trajectories. It may include a technique wherein the STF augments the Separation Factor, enriching the interpretation of STF for enhanced precision in drilling trajectory determination.

An example embodiment may include a system that includes subsurface sensors, a durable computer-readable storage medium, and a processor, designed for the STF computation and its integration into drilling and geosteering frameworks.

An example embodiment may include a strategy for refining wellbore paths in both the planning phase before drilling and during drilling activities, applying the STF to improve trajectory adjustment accuracy. This strategy utilizes STF assessments for guiding real-time trajectory decisions, ensuring the drilling path avoids close proximity to existing wells and geological structures, thus reducing collision dangers and streamlining the drilling workflow. It may include a technique for post-drilling evaluation using STF, aimed at analyzing and contrasting the executed drilling trajectories with the initial plans.

An example embodiment may include a technique for employing the STF in the drilling of sidetracks and multilateral wells, essential for broadening the scope of reconstruction opportunities and enhancing wellbore positioning. This method leverages STF evaluations for meticulous planning of wellbore trajectories, significantly curtailing the risk of inter-wellbore collisions and promoting safe, efficient drilling operations.

It may include a technique where STF computations are tailored to accommodate various depth measurement units, including meters, feet, or yards, ensuring its applicability and relevance worldwide. It may include relative vertical survey errors between two wellbores. It may include a technique for the ongoing enhancement of drilling operations via STF utilization, offering insights into drilling performance and bolstering strategies for collision risk reduction. It may include a method for the integration of geological, geophysical, and drilling data for the computation of the Stratigraphic Factor (STF), facilitating a comprehensive analysis of stratigraphic separation between wells to enhance collision risk assessment accuracy. It may include a software or algorithm developed for processing Stratigraphic Factor (STF) data, designed for integration with geosteering and drilling management systems, providing automated STF calculation and real-time decision support to minimize collision risks. It may include a method utilizing the Stratigraphic Factor (STF) for predictive modeling of collision risks prior to drilling, including drilling trajectory simulations to optimize drilling plans and reduce the potential for well collisions. It may include a method enabling the adaptation of Stratigraphic Factor (STF) calculations to various depth measurement units, including meters, feet, or yards, ensuring its applicability in international drilling operations. It may include a method for post-drilling trajectory analysis using the Stratigraphic Factor (STF) to evaluate deviations from the plan, inform future operation adjustments, and enhance drilling operation safety.

An example embodiment may include a method for real-time wellbore anti-collision analysis, the method comprising receiving measurement-while-drilling (MWD) and logging-while-drilling (LWD) data from downhole sensors, calculating a true vertical thickness (TVT) and true stratigraphic thickness (TST) of a drilled formation using a processor, determining a stratigraphic factor (STF) based on a machine-learning-trained model that processes geological layer boundaries, updating a drilling control system in real time to adjust the drilling trajectory based on the STF, and transmitting trajectory updates to a rotary steerable system to dynamically adjust wellbore pathing.

A variation of the example embodiment may include the processor applying a convolutional neural network to predict optimal STF values based on historical well log data. The wellbore trajectory may be adjusted in response to STF exceeding a predetermined threshold indicating a potential collision risk. It may include generating an ellipsoid of uncertainty (EQU) around the planned trajectory and recalculating separation factors in response to detected geological anomalies. The drilling control system may dynamically modify the drilling trajectory via mud pulse telemetry instructions to a rotary steerable system. It may include receiving real-time resistivity, gamma-ray, and acoustic velocity measurements from downhole sensors to refine the STF calculation by identifying formation boundaries with higher precision. The processor may generate a predictive collision risk profile by integrating historical wellbore deviation data with real-time STF values to provide early warnings of potential drilling hazards.

An example embodiment may include an apparatus for real-time wellbore anti-collision analysis, comprising a plurality of downhole sensors configured to collect measurement-while-drilling (MWD) and logging-while-drilling (LWD) data, a processor communicatively coupled to the downhole sensors, the processor configured to calculate a true vertical thickness (TVT) and true stratigraphic thickness (TST), determine a stratigraphic factor (STF) based on real-time drilling parameters, compare the STF to a collision threshold, generate instructions enabling trajectory adjustment when STF values indicate a high collision probability, and a telemetry module configured to transmit control data enabling trajectory modifications to a rotary steerable system or downhole motor.

A variation of the example embodiment may include the processor continuously refining the stratigraphic factor (STF) based on historical well data and current real-time sensor readings. The telemetry module may comprise mud pulse telemetry and electromagnetic telemetry for downhole communication. It may include a graphical user interface (GUI) that displays STF-derived well path recommendations in a three-dimensional geological model. The processor may generate a predictive collision risk map based on a probabilistic model of stratigraphic separation.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several figures of the drawing. Briefly.

DETAILED DESCRIPTION OF THE EXAMPLE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems, and method steps. It is to be expected that various equivalents, alternatives, and modifications are possible within the scope of the appended claims.

Figure 1:
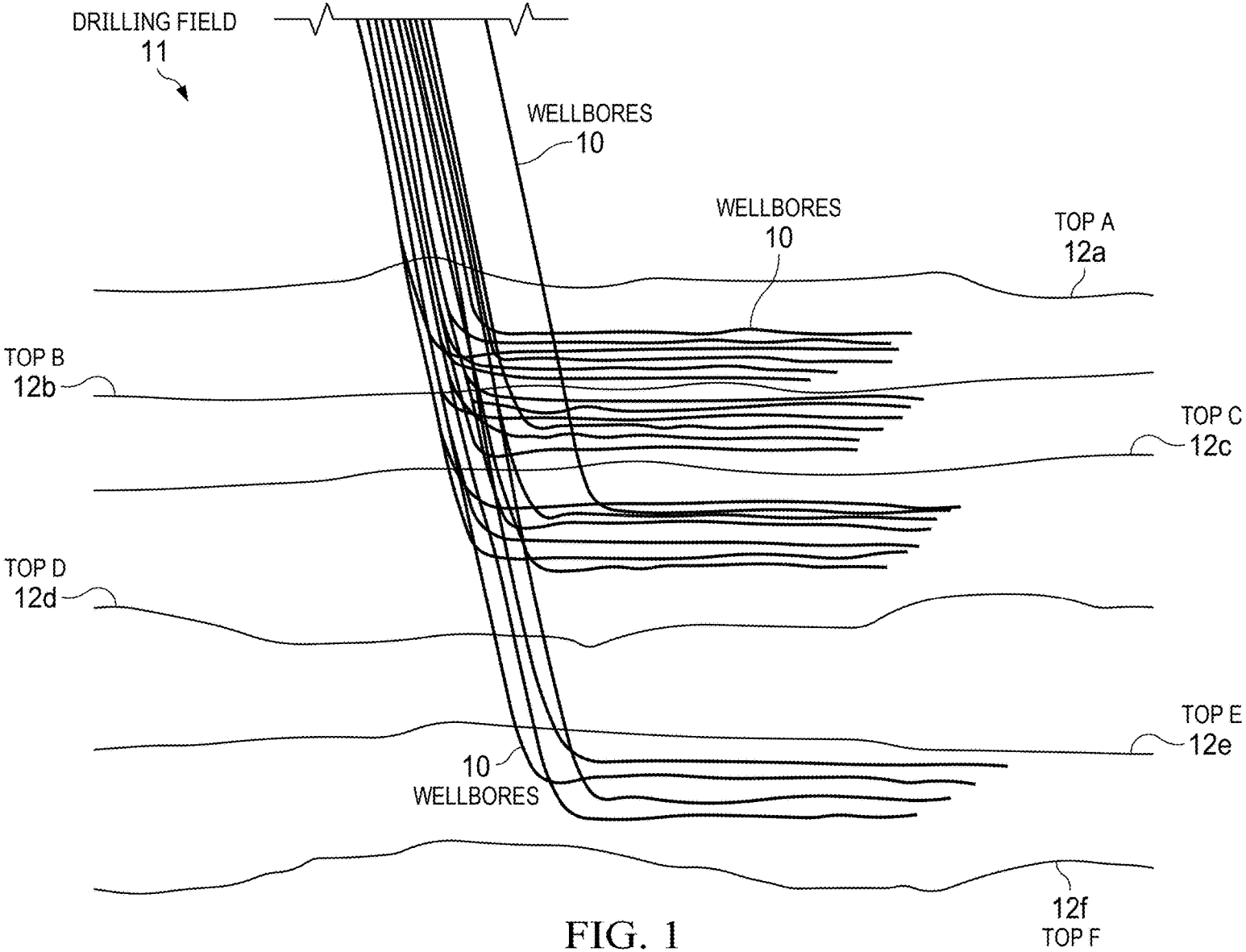
FIG. 1 shows an example of a plurality of drilled wells with respect to geologic tops in place.

Horizontal drilling along the productive formations for greater access to the hydrocarbons-in-place and better production rates is applied industry wide for oil & gas exploration. FIG. 1 illustrates the multiple wellbores 10 drilled along different formations from Top A 12*a* to Top F 12*f*. As multiple wellbores are drilled within the same geologic formations in different orientations, spacing between the wells and possible intersecting of those wellbores is an important aspect to consider for associated risks.

Risks associated with wellbore intersections, also known as collisions, are not limited to but include severe outcomes such as blowouts, the loss of drilling fluids, environmental harm due to the interconnection of reservoirs, as well as significant financial and reputational repercussions. To effectively mitigate these risks, industry protocols mandate the employment of separation factors and oriented separation factors allow for certain deviations from the designated drilling path and require adherence to specified clearance distances between wellbores. These measures are critical in preventing wellbore collisions and ensuring the safety and efficiency of drilling operations.

Figure 2:
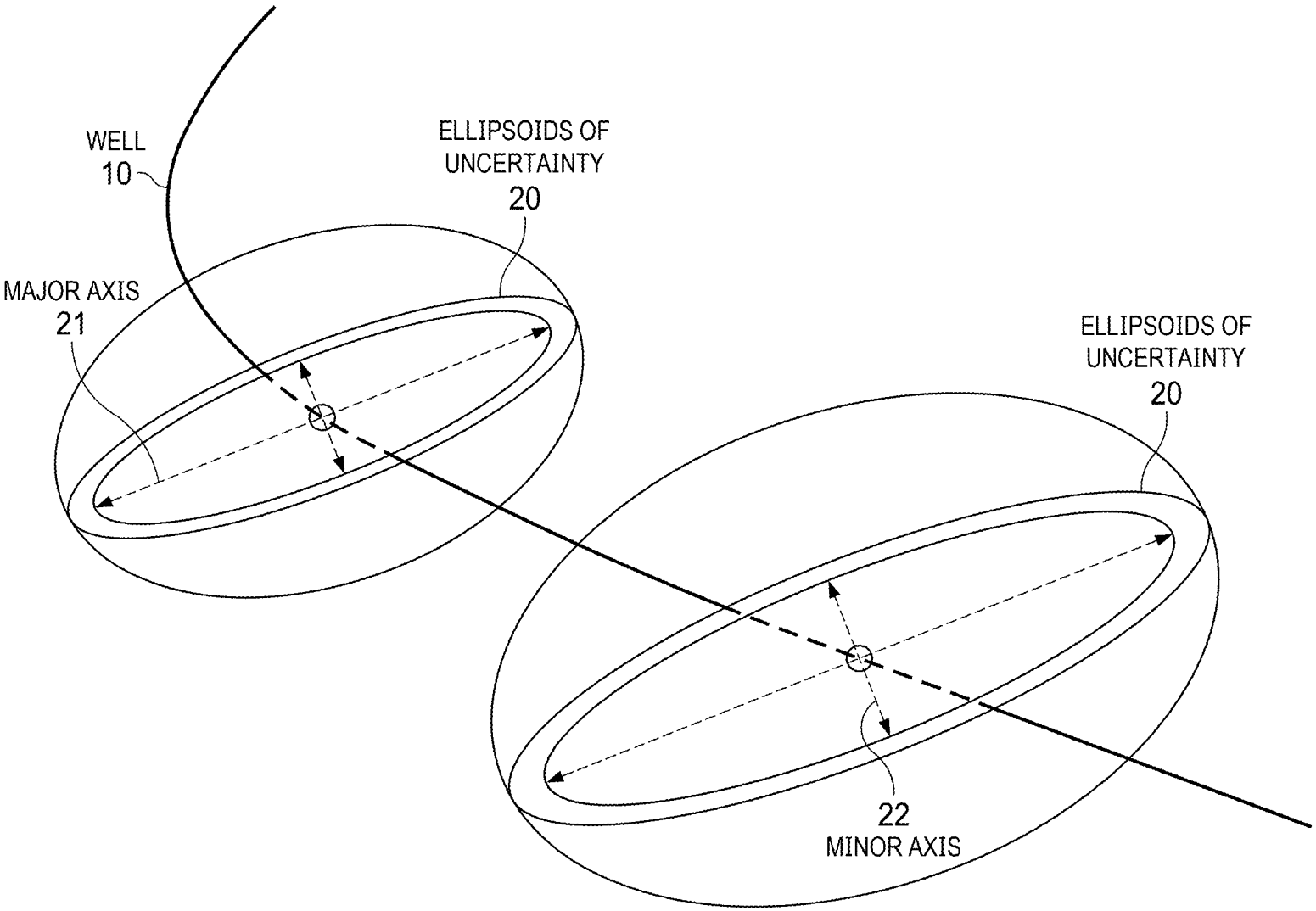
FIG. 2 shows an example of three-dimensional ellipsoids of uncertainty around the planned wellbore path.

Ensuring that each well is drilled according to a detailed plan that specifies its exact spatial orientation—a precision achievable through various technological approaches—is essential for safe drilling operations. Determining the accurate spatial location of the wellbore involves compiling coordinates from multiple points along its trajectory, measured with subsurface tools. The accuracy of these measurements, including depth, azimuth, and inclination angles, is subject to uncertainties, resulting in a three-dimensional "Ellipse of Uncertainty" (EoU) 20 around the planned wellbore path 10. The dimensions of this ellipse are calculated using a survey error model which considers inclination, azimuth and tool accuracy (FIG. 2).

The error model's primary goal is to integrate the effects of various physical factors affecting survey accuracy, thus determining the three-dimensional position error ellipse at any survey point. This principle applies to error models for both Measurement While Drilling (MWD) and gyroscopic systems. Measurement errors can occur randomly or systematically, with random errors typically canceling each other out over multiple measurements due to their varying positive and negative effects. The determination of such error models is very subjective to the variety of error sources and well established in the industry and as such is beyond the scope of this paperwork.

The Ellipsoid of Uncertainty (EoU) 20 is defined by a major axis 21 (the direction of maximum uncertainty) and minor axis 22 (direction of minimum uncertainty). The axes indicate the wellbore's positional uncertainty due to faults in measurement and alignment. As the drilling continues horizontally, the uncertainty is greater (FIG. 2). Based on the survey error models and covariance matrix from them, an EoU radius for major 21 and minor axis 22 may be estimated as:

$$R\max = K \times \sqrt{Ei^2 + (Ea \cdot \tan(I))^2}$$

$$R\min = K \times Ed$$

where:

K=Confidence multiplier (usually 95% confidence)

Ei=Inclination error

Ea=Azimuth error

Ed=Depth Error

I=Inclination angle

Using continuously calculated EoU, wellbore collisions can be prevented using a combination of analytical and probabilistic methods. One way to mitigate collisions is using a probabilistic approach for collision risk assessment, acknowledging that while distance-based rules are straightforward, probability-based rules more accurately reflect real risk levels.

The Separation Factor (SF) may be a metric for such an approach to assess anti-collision effectiveness. This approach involves calculating the Ellipsoid of Uncertainty (EOU), a volumetric representation of the wellbore's positional uncertainty at a specific depth where directional surveys were taken. The Separation Factor (SF), incorporated in standard collision avoidance practices, is determined by dividing the center-to-center distance between two adjacent wells by the sum of the major semi-axes of their respective uncertainty ellipsoids.

The Separation Factor (SF) may be calculated as the following:

$$SF = \frac{D}{(R_1^2 + R_2^2)}$$

where D=Minimum distance between two wellbore trajectories $R_1$=Maximum Position uncertainty of the Reference well path based on EOU $R_2$=Maximum Position uncertainty of the Offset well path based on EOU General interpretation of the Separation Factor (SF) is if the SF is greater than or equal to 1 that indicates a safe separation between reference and offset wells while if the SF is less than 1 may indicate potential risk of collision with other wells and adjustments might be needed to the reference well trajectory or re-determine position of the well.

The introduction of the Oriented Separation Factor (OSF) for more detailed anti-collision analysis assigns specific collision probabilities to given values, refines the analysis beyond the traditional Separation Factor (SF) and allowing for trajectory planning that might be otherwise considered too risky under SF criteria. The OSF is based on the relative orientation between two wellbores and determined minimum separation distance between them (subjectively based on associated risks or set by industry standards or company policies).

The basic OSF equation for horizontal wellbores may be written as:

$$OSF = \frac{D}{S}$$

where D=allowable minimum separation distance to avoid collision (set by the user)

S=actual distance between two wellbores at any given point along the trajectory (based X, Y, Z coordinates of points on the well paths).

Generally, OSF of equal to or greater than 1 indicates a safe separation for drilling to continue and less than 1 is considered too close with high risk of collision. This threshold may vary as per requirements based on drilling conditions and risk tolerance.

The use of such factors is crucial in avoiding well-to-well collisions during pre-drill planning and real-time drilling operations. Despite the utility of these methods, their limitations are particularly evident in areas with high drilling density, especially for extended-reach horizontal wells (ERD), where in-depth statistical and geometric analyses, advanced anti-collision algorithms, and strict quality control over survey data are essential to effectively prevent wellbore collisions. Coupled with the complex and dynamic nature of contemporary drilling necessitates an advanced collision avoidance strategy that addresses both immediate threats and potential uncertainties, underscoring the need for innovative solutions that enhance wellbore trajectory predictability, subsurface positioning accuracy, and collision avoidance measures.

Such an advanced collision avoidance strategy may include, within the realm of drilling operations and geosteering, a particular emphasis on innovative methods and systems designed to avert collisions. An example embodiment of an innovative method, referred herein as Stratigraphic Factor (STF), involves a concept that enhances the Separation Factor (SF) and/or Oriented Separation Factor (OSF) by integrating stratigraphic data related to the well's position with respect to geological formation boundaries can avoid well-to-well collisions. The Stratigraphic Factor (STF) is designed to complement and enhance the anti-collision workflows by integrating stratigraphic data indicative of the well's relative position to geological formation boundaries. While the SF and/or OSF focus on measuring the physical distance between wells to evaluate collision risks, the STF introduces a nuanced layer of analysis by considering the stratigraphic differentiation and geological positioning. This dual approach enables more accurate determination of safe drilling trajectories, significantly reducing the likelihood of collisions in densely drilled environments. This forward-thinking approach leverages geological insights to fine-tune well placement strategies for drilling operations in close proximity. Through a comprehensive analysis of geological strata, the STF method seeks to improve well positioning accuracy, thereby minimizing collision risks in complex drilling environments.

FIG. 1 offers a comprehensive three-dimensional visualization of horizontal well paths 10 within a specified drilling field 11 with respect to geologic tops 12(*a-f*) in place. It provides an intricate view of the spatial layout and density of multiple well trajectories, showcasing their relative positions and orientations in a subsurface environment. By illustrating the proximity and directional paths of these wells, the diagram serves as a crucial tool for understanding the complex logistics of planning and executing drilling operations in areas with high well density.

FIG. 2 provides a detailed view of a wellbore 10, emphasizing the ellipsoids of uncertainty 20 that arise due to measurement inaccuracies during drilling operations. It illustrates how the wellbore's planned trajectory can deviate from its actual path because of factors such as tool inaccuracies, environmental influences, or geological variances. The uncertainty zones are depicted as areas surrounding the wellbore trajectory, highlighting the potential variances in the well's actual versus planned positions. This visualization is instrumental in understanding the importance of precision in wellbore positioning and the impact of measurement uncertainties on drilling safety and efficiency.

Figure 3:
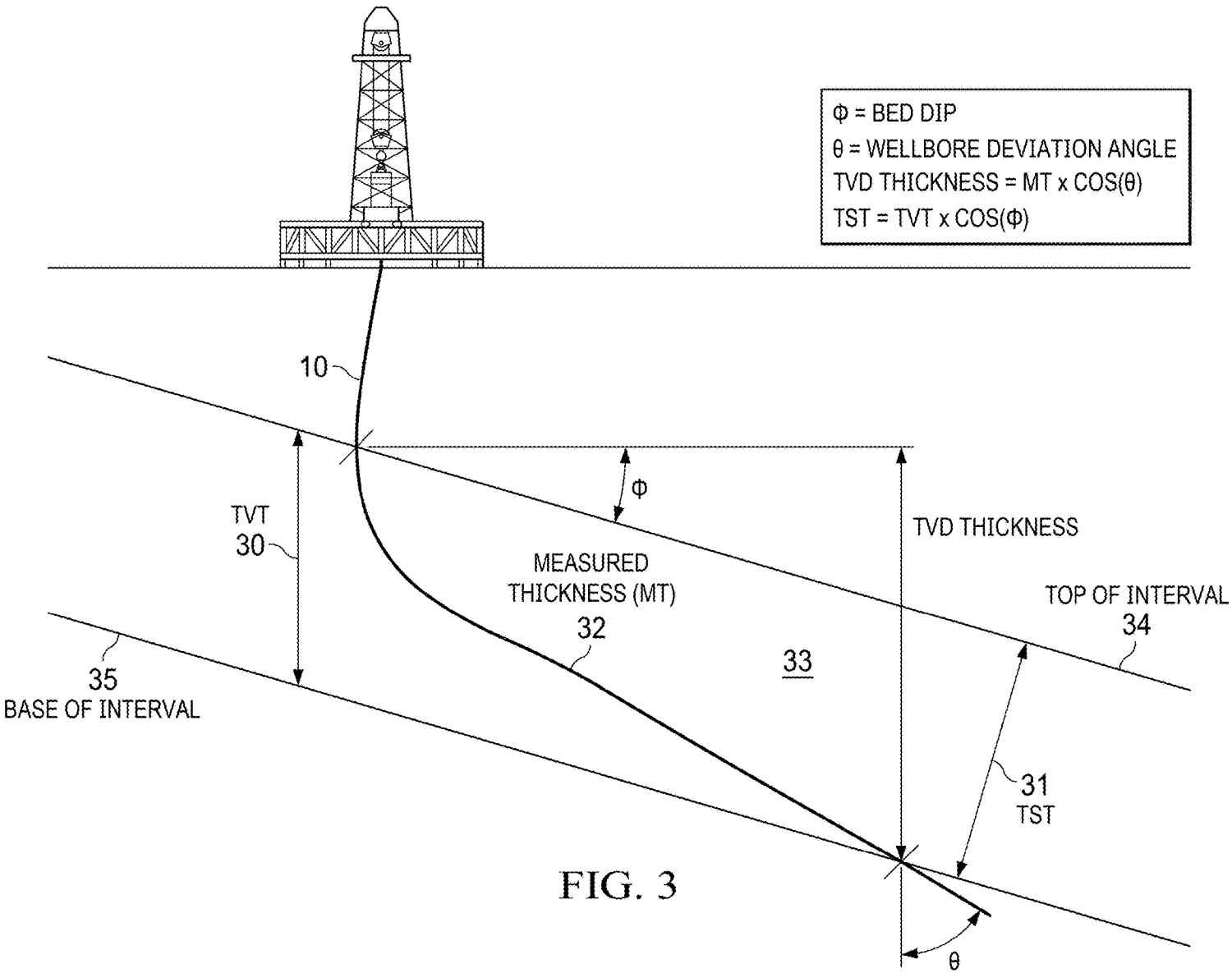
FIG. 3 presents a schematic illustration of a geological cross-section, showcasing the application of True Vertical Thickness (TVT) and True Stratigraphic Thickness (TST) measurements in relation to a wellbore's trajectory.

FIG. 3 presents a schematic illustration of a geological cross-section, showcasing the application of True Vertical Thickness (TVT) 30 and True Stratigraphic Thickness (TST) 31 measurements in relation to a wellbore's 10 trajectory and the measured thickness (MT) 32. The diagram visually delineates the differences between TVT and TST, highlighting how each measurement is derived and applied within the geological strata 33 bound by the top of the interval 34 and the base of the interval 35. The illustration clarifies the distinction between TVT, which is measured as the vertical distance between the top and bottom boundaries of a geological layer, and TST, which is measured perpendicularly to the dip of the geological layer, from its top to its bottom boundary. By depicting the wellbore's trajectory in context with these measurements, the diagram serves to elucidate the stratigraphic placement of the wellbore.

Figure 4:
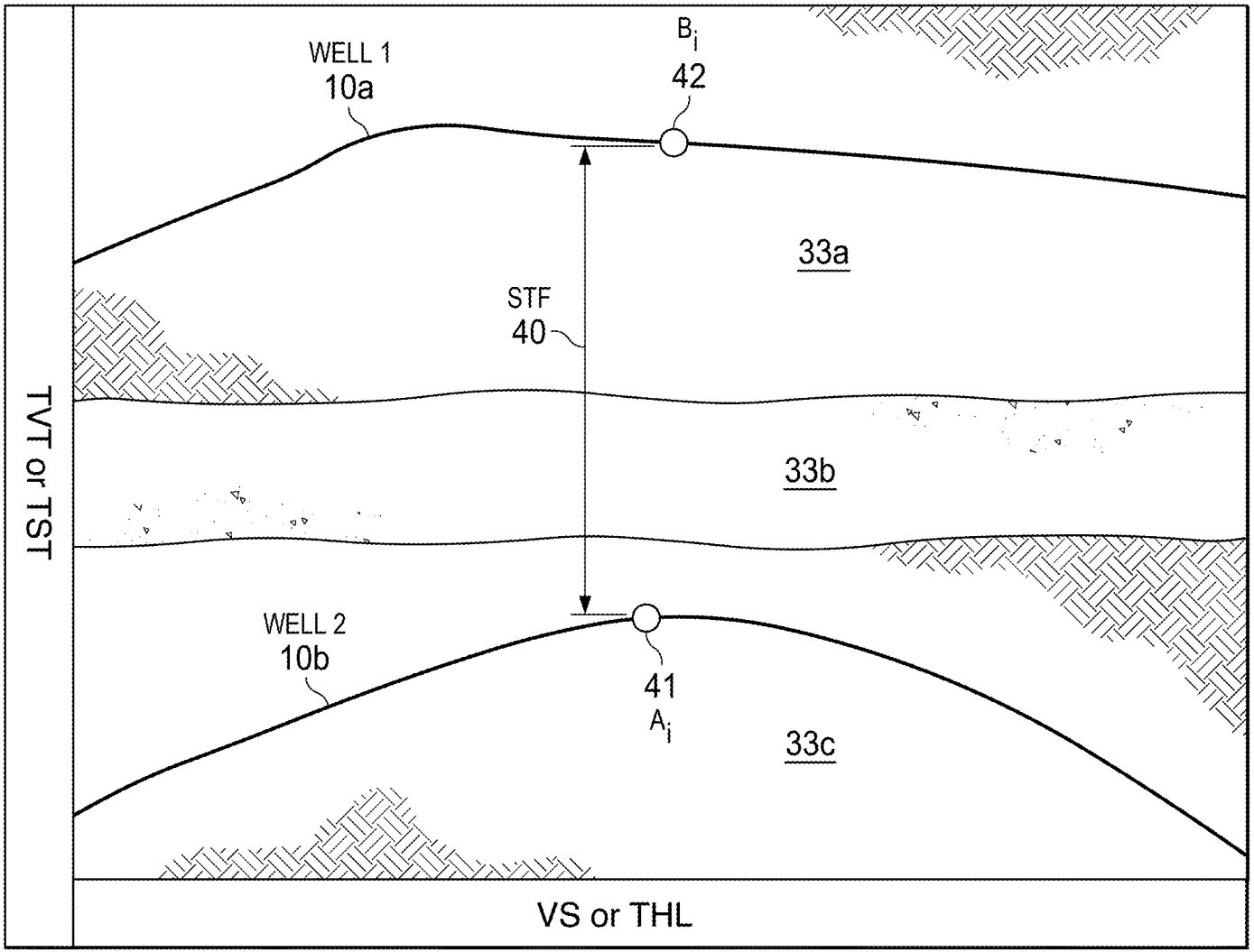
FIG. 4 shows an example for computing the Stratigraphic Factor (STF), highlighting the alignment of wellbore trajectories interpreted within the geological layers.

FIG. 4 illustrates the methodology for computing the Stratigraphic Factor 40 (STF), highlighting the alignment of wellbore trajectories 10*a* and 10*b* across various geological layers 33*a*, 33*b*, and 33*c*. The vertical dimension is represented by either the True Vertical Thickness (TVT) or True Stratigraphic Thickness (TST). For the horizontal dimension, either the Vertical Section (VS)—the horizontal distance from the wellhead to a survey point, measured along a pre-defined azimuth in the horizontal plane, or the True Horizontal Length (THL)—the actual measured length of the wellbore path in the horizontal direction, can be used.

Figure 5:
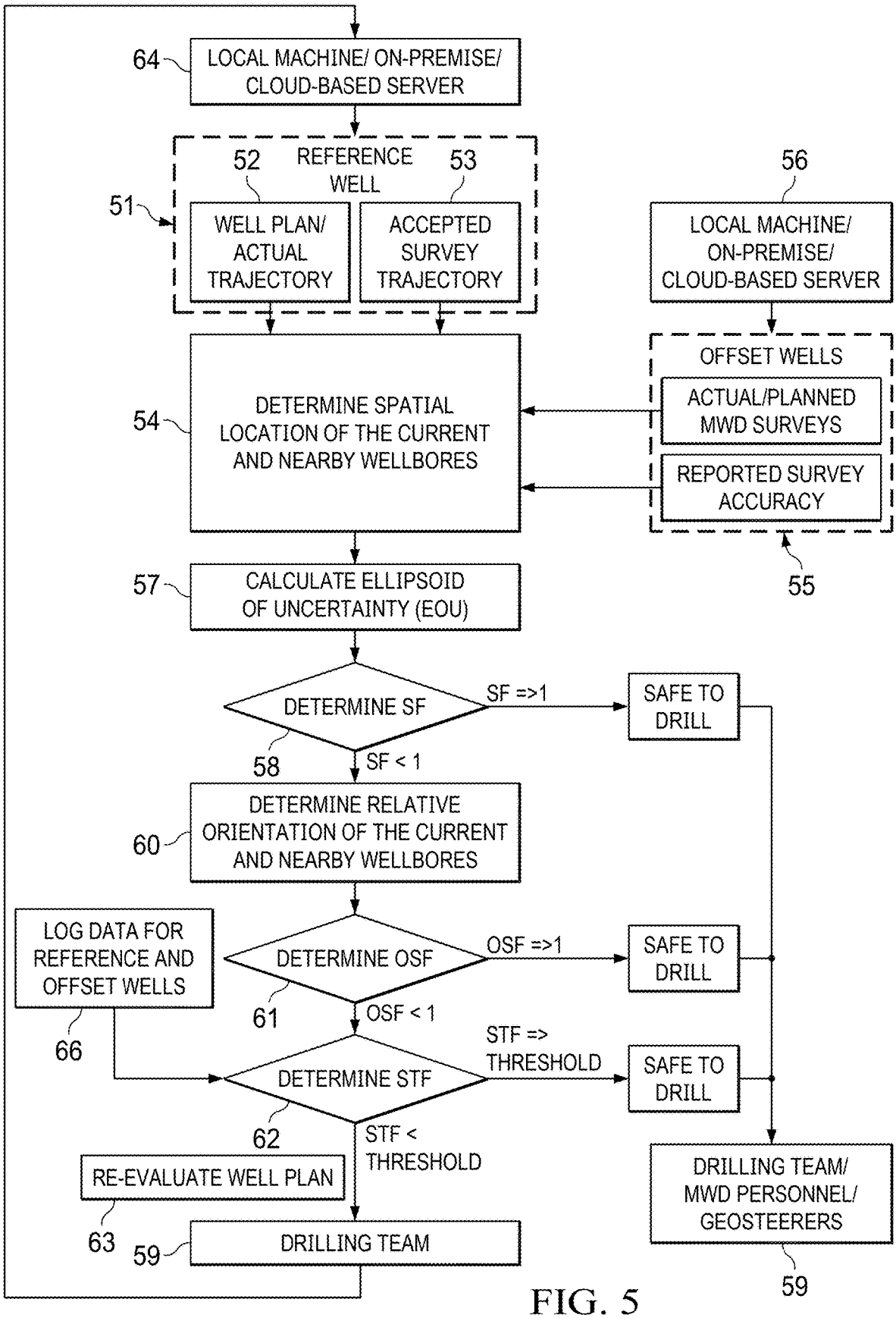
FIG. 5 shows an example of decision-loop incorporating the factors from anti-collision perspective to drill.

FIG. 5 illustrates what a decision-making process may look like when considering the well to be drilled with the existing neighboring wells. The process begins using the widely used Separation Factor (SF) and narrow down using more parameters and inputs to give users a clear idea on the collision possibilities and drilling prospects.

Figure 6:
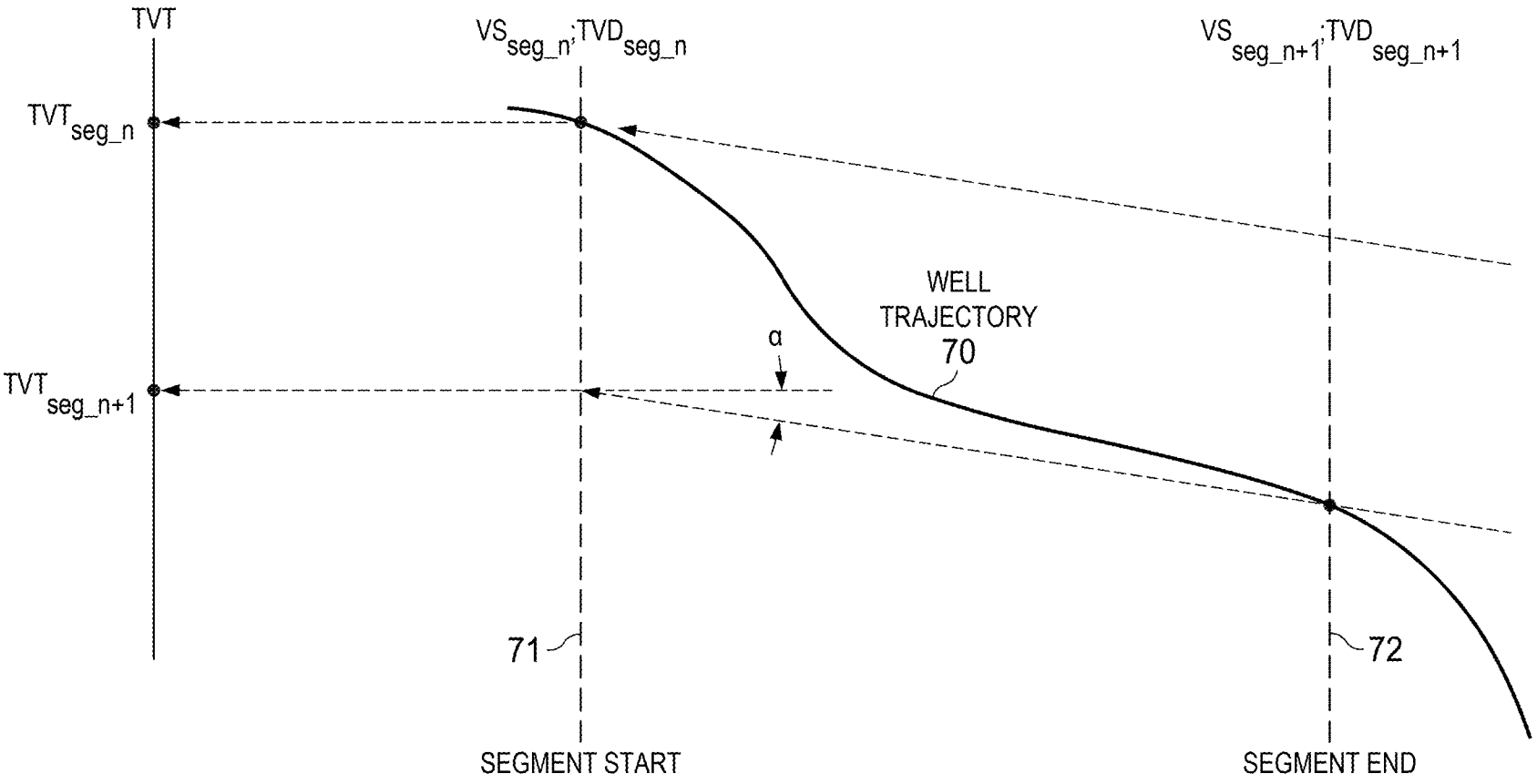
FIG. 6 shows an example embodiment of measured depth, along well trajectory, to TVT scaling.

FIG. 6 illustrates how measured length along the drilled well trajectory is converted to True Vertical Thickness (TVT) giving more nuanced interpretation of the well path with respect to vertical spacing of the wells.

The innovation behind the Stratigraphic Factor (STF) method is its application of stratigraphic True Vertical Thickness (TVT) data to calculate the degree of stratigraphic separation between wellbores (FIG. 3). By incorporating the geological characteristics of the drilled layers, this method more accurately establishes the wellbore's location in relation to formation boundaries, thereby assessing collision risks more effectively than traditional spatial analysis techniques like Ellipsoids of Uncertainty (EOU), which may suggest possible overlaps. This advancement in precision for analyzing wellbore trajectories markedly enhances the safety and efficiency of drilling operations.

The STF method is designed to complement existing geosteering systems, supporting real-time decision-making and adjustments to drilling trajectories. This integration is vital for maintaining appropriate wellbore separation, particularly in geologically complex settings. Moreover, its adaptability allows for application across a spectrum of drilling technologies, encompassing both vertical and directional drilling.

This approach benefits from measurement-while-drilling (MWD) and logging-while-drilling (LWD) data to improve the understanding of geological formations. This enhanced geological insight enables more precise positioning of the wellbore trajectory in relation to formation boundaries, thereby ensuring more accurate drilling aligned with targeted geological layers.

The anti-collision workflow, highlighted as an example embodiment in FIG. 5, may begin with selecting a reference well 51, either vertical or directional, with neighboring offset wells 55 already drilled, and share similar geologic formations within the drilling area. The required data is stored at local storage devices or on-premises servers or cloud-based 64 and 56 as per client's preference. The reference well could be a prognosed well plan with an actual trajectory 52 with planned survey points, with expected inclination and azimuth, along with accepted survey accuracy 53. Offset wells 55 may comprise actual or planned MWD surveys and/or reported surveys that are found on a local machine, on premise, or on a cloud-based server 56.

Determining the accurate spatial location 54 of the current and nearby wellbores includes determining the location of the currently drilled wellbore with respect to the plurality of existing wellbores in real-time time by compiling coordinates from multiple points along the currently drilled trajectory, measured with subsurface tools such as Measurement While Drilling (MWD) tools that provide real-time data about the well's trajectory and drilling conditions. MWD tools are placed in the bottom hole assembly (BHA) and transmit data to the surface using sensors such as accelerometers to measure inclination (angle from vertical), magnetometers to determine azimuth (direction relative to magnetic north), gyroscopes to determine orientation, pressure sensors to monitor downhole pressure changes. Additional tools may include logging while drilling (LWD) which provide geological and petrophysical data to help steer the well accurately into the reservoir. LWD tools may include gamma ray logs to detect natural radiation to distinguish rock formations, resistivity logs to measure formation resistivity to identify hydrocarbon-bearing zones, and neutron and density logs to determine formation porosity and lithology. Additional methods of determining the location of the wellbore with respect to the existing wellbores may include gyroscopic surveys using gyro tools that are used in high-accuracy applications, especially in magnetic interference zones or offshore drilling which provide precise directional data and are often used in cased hole surveys. Wireline surveys may be used when drilling is paused, these tools are lowered into the wellbore on a wireline to measure inclination and azimuth. Gyro wireline surveys may be used in deviated or horizontal wells for high-accuracy surveys. Surveying techniques may also be used, such as single-shot and multi-shot surveys which use film or electronic sensors to capture inclination and azimuth at different depths. North-seeking gyros may provide precise location data independent of magnetic interference. Steering tools may give real-time inclination and azimuth data to help directional drillers adjust the well path. Another method to help determine location is resistivity-at-the-bit measurements which measures formation resistivity very close to the bit, allowing for real-time geosteering. Acoustic and electromagnetic telemetry may also be used and involve and transmit MWD and LWD data to the surface, particularly in environments where traditional mud pulse telemetry is ineffective.

The example embodiment then calculates 57 a three-dimensional "Ellipse of Uncertainty" (EoU) around the planned wellbore path based on the accuracy of these measurements, including depth, azimuth, and inclination angles.

For the reference wells, the planned trajectory 52 is determined as part of pre-drill well planning. For every set operator-specified depth interval along the required pre-drill trajectory survey points including a measured depth, inclination and azimuth are determined to be used in workflow. The pre-drill trajectory is based on multiple datasets including drilled geology & target geologic zone of interest and geomechanical properties of the rock.

If the well is currently drilling, then existing surveys, including the measured depth, inclination and azimuth, are obtained by downhole MWD survey tools and sent to the surface via mud pulse telemetry which uses pressure pulses in the mud to send data to the surface and is most widely used in oil and gas drilling operations. This data is then disseminated to the client specified personnel for further usage or transmitted by third-party service providers on the rig to the client specified data storage location. These existing real-time surveys used along with pre-determined well plan surveys get the wellbore trajectories for the reference well.

The offset wells 55 similarly consist of real-time surveys including measured depth, inclination and azimuth acquired when those wells were drilled or could be like reference wells could include pre-determined surveys in case those are to be drilled at some time in the future.

Using the planned and/or real-time well plan trajectory for reference well 51 and drilled/to-be drilled trajectories of the offset wells 55, spatial location of each well is determined 54. The Ellipsoid of Uncertainty (EoU) is calculated 57 and following separation factors 58 to 62 are determined for safe drilling of the reference well. Once the conditions for safe drilling of the reference well is verified, the trajectory at which to drill the reference well is distributed to the drilling team 59, such as by way of example a graphical user interface detailing the well path recommendations in a three-dimensional geological model, who then formulate or make changes to the drilling plans which include casing set points, drilling fluids requirements, downhole drilling tools and their specifications, etc.

The process may be human intensive with multiple layers of decision-makers and executing personnels, office-based and/or on-site drilling, using the information to make multiple decisions to drill the reference well safely. The determined EoU and separation factors are used by the drilling personnel and geosteering teams in real-time as the actual surveys sent from the rig site are used to evaluate the collision risks while the well is drilled and help in faster real-time decisions as and when necessary.

The Separation Factor (SF) is determined 58 along points of the planned trajectory of the reference well with respect to the offset wells 55. Utilizing industry set threshold of 1, decision is made if the reference well can be drilled. If SF is less than 1, relative orientation of the trajectories for reference well and offset wells are determined 60 and Oriented Separation Factor (OSF) is determined 61. Using industry-wide used threshold of 1 or client defined constraint, based on risk assessment and drilling conditions, the drilling readiness is determined. If that threshold is also not met, then Stratigraphic Factor (STF) 62 can be used to enhance the decision-making process to drill the reference safely.

Implementing STF involves aligning analyzed wells on a TVT basis. Utilizing log data 66 from the reference well, the geophysical characteristics of each layer in the drilled section can be identified. The selection of the reference well is aided by inter-well correlation and a structural map of the formation's surface. After identifying geological formation boundaries and calculating True Vertical Thickness (TVT), the reference well's physical properties at each log point are projected onto the True Horizontal Length (THL) or Vertical Section (VS) interval of the actual wells.

The TVT scale is a projection of True Vertical Depth (TVD) depth onto the same TVD scale. The TVT projection is performed so that the data of a vertical well can be used for the trajectory points. A vertical trajectory passes through geological layers only at a certain place. The data collected from it is tied to the depth of this well. The same layers can have a different formation at a distance from the vertical well. A geologic layer may behave differently at the place where the horizontal well is located than where the vertical one is somewhere it may have shifted, somewhere it may have bent. To understand which data of a vertical well is applicable to a certain point of a horizontal one, it is necessary to project the points of a horizontal one repeating the behavior of the layers.

This is further depicted in FIG. 6 where the well-trajectory 70 passes through a segment start 71 and a segment end 72. It shows in the visualization how the True Vertical Thickness (TVT) is determined along a trajectory at two different points using the Vertical Section (VS), TVD and Dip of the formation (a) in which the well trajectory is.

The example equation for calculating TVT is as follows:

$$TVT(\text{seg_n}+1) = TVD(n) - [VS(\text{seg_n}+1) - VS(\text{seg_n})] \times \tan(\alpha)$$

The equation highlighted above uses the difference in VS of the well trajectory between the start of the segment and end of the segment with the tangent of the interpreted apparent dip of the formation (a) from the end of the segment subtracted from with the actual TVD at start of the segment.

This results in a TVT-scaled plot of well trajectories that more accurately maps the spatial position of wellbores relative to stratigraphic boundaries (FIG. 4). The shortest distances between well axes for a sequence of actual measurements are identified, and the Stratigraphic Factor 40 (STF) is calculated accordingly using the formula:

$$STF = TVT(Ai) - TVT(Bi)$$

where STF 40 represents the stratigraphic separation between two closest points on different wellbore paths (Well 1 10*a* and Well 2 10*b*), denoted as Ai 41 and Bi 42 in FIG. 4. This distance is crucial for evaluating the spatial separation of wellbores and assessing collision risks within distinct stratigraphic layers, thereby enabling more precise and safer drilling operations. This calculation also highlights this method's ability to adapt to various depth measurement units, such as meters, feet, or yards, making it widely applicable in diverse drilling scenarios worldwide.

The calculation of the Stratigraphic Factor (STF) in the example embodiments determines the stratigraphic separation between two points on different wellbore paths. The STF calculation during drilling is based on refined geological data acquired through MWD and LWD techniques, with the TVT plot adjusted according to this interpreted data rather than direct measurements.

A user-defined threshold, based on assessed risk, drilling requirements and user experience, is used as a condition to drill. A STF above or equal to the threshold would be considered satisfactory to drill while below threshold could mean re-evaluating the whole well plan trajectory 63 for the reference well and going through the conditional loop (FIG. 5) to determine its feasibility.

Consequently, the application of the Stratigraphic Factor (STF) significantly enhances the safety of drilling operations. By ensuring that wellbores are drilled within distinct geological strata, the STF method effectively mitigates collision risks, even in scenarios where the Separation Factor (SF) indicates a high likelihood of intersecting trajectories. This approach allows for strategic drilling in close proximity, with the confidence that wells are positioned in separate geological layers, thereby minimizing the potential for collisions. The STF not only complements the SF by providing an additional layer of safety analysis but also enables drilling operations to proceed safely in densely drilled fields where traditional SF values might suggest unacceptable collision risks. This strategic layering of wells, facilitated by STF, ensures that drilling can be conducted with minimized risk, leveraging geological stratification to provide a natural barrier against wellbore intersections.

Beyond its operational benefits, the STF method is instrumental in the planning phase of drilling operations. By applying the method before drilling begins, operators can design wellbore trajectories that fully account for subsurface geological conditions, significantly minimizing collision risks and boosting drilling efficiency.

In real-time, the STF method enhances the interpretation of the real-time surveys coming from the rig site as the reference well is drilled. Real-time surveys of the drilled trajectory from MWD downhole tools are compared against determined pre-drill trajectory along with determination of current possibilities of collisions with offset wellbores.

It should be noted that the collision-free trajectory data is usually used by drilling personnels, to make changes to the operating conditions of the downhole tools or in case of Rotary Steerable tools transmit the desired inclination and azimuth to the steering tool. Subsequent real-time surveys, in measured depth, inclination and azimuth, and/or data, like continuous inclination and azimuth, transmitted from the MWD tool are then used to confirm on how closely the drilled wellbore is following the determined collision-risk trajectory.

For post-drilling analysis, the STF method meticulously evaluates actual drilling trajectories against planned ones within the same geologic interval. It quantifies deviations for precise adjustments in future operations and enhances safety by guiding strategies to reduce risks in forthcoming drilling efforts.

Additionally, STF method serves as a powerful tool for examining drilling issues and incidents, offering a comprehensive analytical framework to investigate and understand factors leading to operational challenges or accidents. This in-depth analysis promotes a culture of continuous improvement, drilling accuracy, and operational safety.

To facilitate real-time wellbore anti-collision analysis, the Stratigraphic Factor (STF) may be computed using a combination of sensor fusion algorithms that aggregate data from Measurement-While-Drilling (MWD) and Logging-While-Drilling (LWD) tools. The system may utilize subsurface sensors, including gyroscopic tools, accelerometers, magnetometers, and resistivity-at-the-bit instruments, to continuously acquire and transmit wellbore positioning data to a dedicated processing unit. The processing unit may integrate the collected data to dynamically update the STF calculation, which improves the accuracy of stratigraphic separation analysis. The STF accounts for real-time geological formations and reservoir heterogeneity, enhancing collision risk assessment.

The STF may be further refined using machine-learning-assisted models that analyze historical drilling data, geological surveys, and sensor feedback to provide predictive analysis of potential wellbore collisions. A convolutional neural network (CNN) processes high-resolution geophysical logs to identify subtle stratigraphic variations that may impact well placement accuracy. The machine-learning model continuously improves as new data is introduced, allowing for adaptive, self-correcting stratigraphic mapping. This approach significantly increases geosteering precision, reduces the likelihood of wellbore intersections, and enables high-density well drilling in complex reservoirs.

The STF-based anti-collision system may operate through a dedicated processor unit housed within a drilling control system, which receives continuous wellbore positioning data from downhole telemetry tools. The system includes a non-transitory computer-readable medium storing instructions that execute STF calculations and adjust the wellbore trajectory based on real-time conditions. The telemetry module, which supports mud pulse telemetry, electromagnetic telemetry, and acoustic transmission, ensures rapid data transfer between downhole sensors and surface control units.

Upon determining a high-risk stratigraphic proximity based on STF calculations, the processor may transmit corrective drilling commands to a rotary steerable system (RSS) or a downhole motor, adjusting inclination and azimuth to maintain a safe trajectory. The STF-based corrections are executed automatically, removing the need for manual intervention and significantly improving the reaction time to unforeseen geological anomalies. The integration of real-time geophysical feedback allows drilling engineers to maintain optimal wellbore placement with greater accuracy compared to conventional geosteering techniques. The processor may generate a predictive collision risk profile by integrating historical wellbore deviation data with real-time STF values to provide early warnings of potential drilling hazards.

Incorporating real-time geological properties, allows the example embodiments to reduce false positives in collision detection, allowing wells to be drilled more closely without compromising safety. This is particularly beneficial in tight drilling environments, such as offshore fields or unconventional reservoirs, where maximizing well placement efficiency is crucial for economic feasibility.

For instance, in offshore deepwater drilling, conventional separation factor models may lead to overly conservative well spacing, reducing reservoir drainage efficiency. By using STF-enhanced geosteering, drilling operators can safely place wellbores closer together while still avoiding collisions, optimizing reservoir recovery rates. Additionally, STF-enhanced geosteering is particularly advantageous in extended-reach drilling (ERD) scenarios, where high uncertainty in wellbore positioning makes traditional anti-collision techniques less reliable.

The example embodiments leverage real-time geological feedback, sensor fusion, and machine learning models to dynamically adjust wellbore trajectories. The system actively modifies drilling operations based on live geological data, rather than merely providing passive collision warnings. This results in a technical improvement to geosteering processes that enhances both drilling efficiency and safety.

The example embodiment's ability to autonomously adjust wellbore paths based on stratigraphic factors represents a non-routine advancement over standard collision avoidance methodologies. In contrast to purely mathematical approaches that rely on geometric calculations, The disclosed embodiments may use STF-enhanced geosteering as an interactive system that integrates geophysical parameters, real-time telemetry, and machine-learning-driven analysis to optimize wellbore positioning.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A method for real-time wellbore anti-collision analysis, the method comprising:

receiving measurement-while-drilling (MWD) and logging-while-drilling (LWD) data from downhole sensors;

calculating a true vertical thickness (TVT) and true stratigraphic thickness (TST) of a drilled formation using a processor;

determining a stratigraphic factor (STF);

refining the STF using a machine-learning-trained model that analyzes historical drilling data, geological surveys, and sensor feedback to provide predictive analysis of potential wellbore collisions;

updating a drilling control system in real time to adjust the drilling trajectory based on the STF; and transmitting trajectory update instructions to a rotary steerable system to dynamically adjust the drilling trajectory.

2. The method of claim 1, wherein the processor applies a convolutional neural network to predict optimal STF values based on historical well log data.

3. The method of claim 1, wherein the wellbore trajectory is adjusted in response to STF exceeding a predetermined threshold indicating a potential collision risk.

4. The method of claim 1, further comprising:

generating an ellipsoid of uncertainty (EOU) around the planned trajectory; and recalculating separation factors in response to detected geological anomalies.

5. The method of claim 1, wherein the drilling control system dynamically modifies the drilling trajectory via mud pulse telemetry instructions to a rotary steerable system.

6. The method of claim 1, further comprising receiving real-time resistivity, gamma-ray, and acoustic velocity measurements from downhole sensors to refine the STF calculation by identifying formation boundaries with higher precision.

7. The method of claim 1, wherein the processor generates a predictive collision risk profile by integrating historical wellbore deviation data with real-time STF values to provide early warnings of potential drilling hazards.

8. An apparatus for real-time wellbore anti-collision analysis, comprising:

a plurality of downhole sensors configured to collect measurement-while-drilling (MWD) and logging-while-drilling (LWD) data;

a processor communicatively coupled to the downhole sensors, the processor configured to:

calculate a true vertical thickness (TVT) and true stratigraphic thickness (TST);

determine a stratigraphic factor (STF) based on historical drilling data, geological surveys, and real-time drilling sensor feedback from the plurality of downhole sensors;

compare the STF to a collision threshold;

generate trajectory adjustment instructions when STF values indicate a high collision probability; and a telemetry module configured to transmit trajectory instructions to a rotary steerable system or downhole motor.

9. The apparatus of claim 8, wherein the processor continuously refines the stratigraphic factor (STF) based on historical well data and current real-time sensor readings.

10. The apparatus of claim 8, wherein the telemetry module comprises mud pulse telemetry and electromagnetic telemetry for downhole communication.

11. The apparatus of claim 8, further comprising a graphical user interface (GUI) that displays STF-derived well path recommendations in a three-dimensional geological model.

12. The apparatus of claim 8, wherein the processor generates a predictive collision risk map based on a probabilistic model of stratigraphic separation.

* * * * *